United States Patent [19]

Incremona et al.

[11] Patent Number: 4,919,994

[45] Date of Patent: Apr. 24, 1990

[54] DRY TRANSFER GRAPHICS ARTICLE AND METHODS OF PREPARATION AND USE THEREOF

[75] Inventors: Joseph H. Incremona, Stillwater; Richard H. Lundeen, Woodbury, both of Minn.

[73] Assignee: Minnesota Mining and Manufacturing Company, St. Paul, Minn.

[21] Appl. No.: 25,117

[22] Filed: Mar. 20, 1987

Related U.S. Application Data

[63] Continuation-in-part of Ser. No. 846,755, Apr. 1, 1986, abandoned.

[51] Int. Cl.[5] ..... B41M 5/00

[52] U.S. Cl. ..... 428/141; 156/234; 156/239; 156/240; 156/277; 428/201; 428/202; 428/207; 428/211; 428/352; 428/353; 428/354; 428/454; 428/914

[58] Field of Search ..... 428/201–204, 428/207, 211, 914, 141, 195, 343, 352–354, 454; 156/230, 234, 239, 240, 277

[56] References Cited

U.S. PATENT DOCUMENTS

| | | | |
|---|---|---|---|
| 3,013,917 | 12/1961 | Karlan et al. | 154/46.8 |
| 3,298,850 | 1/1967 | Reed | 428/914 |
| 3,331,729 | 7/1967 | Danielson et al. | 161/162 |
| 3,684,544 | 8/1972 | Piron | 117/3.1 |
| 3,741,787 | 6/1973 | Tordjman | 117/3.1 |
| 3,847,725 | 11/1974 | Hochner | 161/167 |
| 3,987,225 | 10/1976 | Reed et al. | 428/43 |
| 4,028,165 | 6/1977 | Rosenfeld | 156/234 |
| 4,028,474 | 6/1977 | Martin | 428/40 |
| 4,111,734 | 9/1978 | Rosenfeld | 156/234 |
| 4,177,309 | 12/1979 | Shadbolt | 428/195 |
| 4,192,576 | 3/1980 | Tung et al. | 350/105 |
| 4,286,008 | 8/1981 | Reed | 428/914 |
| 4,340,276 | 7/1982 | Maffitt et al. | 350/164 |
| 4,374,691 | 2/1983 | Vanden Bergh | 156/234 |

*Primary Examiner*—Bruce H. Hess

*Attorney, Agent, or Firm*—Donald M. Sell; Walter N. Kirn; Robert H. Jordan

[57] ABSTRACT

A dry transfer graphics article and methods of preparation and use thereof are provided. The article is self-weeding to transfer fine graphic images without the use of detackifying radiation, solvents, etc. One of the elements of the article is a carrier having a surface which is compatible with an adhesive having a low work to fracture. The article further comprises a graphic pattern formed on the adhesive.

22 Claims, 1 Drawing Sheet

DRY TRANSFER GRAPHICS ARTICLE AND METHODS OF PREPARATION AND USE THEREOF

CROSS-REFERENCE TO RELATED APPLICATION

This application is a continuation-in-part of pending patent application Ser. No. 846,755, filed Apr. 1, 1986, now abandoned.

TECHNICAL FIELD

This invention relates to a dry transfer graphics article and methods of preparation and use thereof. More particularly, the invention relates to a transfer graphics article which allows for the transfer of a graphic pattern to substrates without the necessity for conventional die cutting or weeding.

BACKGROUND ART

Two of the most common methods of applying images to a substrate are by direct painting or screening, or by the use of die-cut, weeded, and premasked film. The former approach is time consuming and expensive, requiring relatively skilled labor, long application times, and can potentially contaminate adjacent areas. As for the latter, die-cutting and weeding represent substantial expenditures of time and money, and do not lend themselves to the manufacture and transfer of small images such as fine lines, halftones, etc Such a system typically involves a polymeric film bearing a graphic design with a layer of adhesive under the graphic design protected by a liner. To provide the desired design, such films are die and/or "kiss cut". The resultant design is then bonded to a desired substrate via the adhesive layer after liner removal.

To overcome these noted deficiencies, much attention has been directed in the literature to the development of self-weeding, dry transfer assemblies.

Included in these approaches are those wherein adhesive is printed onto and only onto the graphic design, such as disclosed in U.S. Pat. Nos. 4,028,474 (Martin), 4,028,165 (Rosenfeld), and 4,421,816 (Arnold). This approach is difficult in that registration must be exact and as such is especially critical for the transfer of fine lines, halftone dots, etc.

Another approach includes that wherein the adhesive is applied over the entire surface of the support sheet and graphic design, relying on various mechanisms for adhesive cleavage at the edges of the image areas, Specifically, U.S. Pat. No. 3,987,225 (Reed et al.) and British Pat. No. 959,670 (Mackenzie) disclose articles wherein adhesive shear is induced at the edges of the indicia to assist in differential transfer, by incorporation of a solvent or dispersing powder in the adhesive.

Others have used the concept of migrating components to advantage. In U.S. Pat. No. 4,177,309 (Shadbolt) a polar wax serves to lower the tack of adhesive not in contact with image areas while simultaneously unaffecting or minimally affecting adhesive in contact with image areas. U.S. Pat. No. 3,741,787 (Tordjman) discloses solvent migration as a means of disrupting the bond between the graphic indicia and the carrier, thereby allowing for the transfer of the indicia from the carrier to the substrate. Similarly, U.S. Pat. No. 3,684,544 (Piron) discloses the utility of material displacement from the ink into the adhesive to cause differential tackification of the image-contacting adhesive relative to the exposed adhesive.

Photosensitive peel-apart or wet-development articles have been reported that are especially useful for the development and preparation of small graphics. These articles require either irradiative or thermal imaging procedures. U.S. Pat. No. 4,454,179 (Bennett et al.) discloses the preparation of a dry transfer article wherein differential tack and transfer characteristics are achieved by photochemical means. Specifically, graphics are printed onto the surface of a low energy carrier such as polypropylene, and subsequent to drying and corona treatment, both graphics and carrier are overcoated with an actinic radiation-responsive adhesive. To facilitate differential tackification, the adhesive is exposed using the graphics as the exposure mask. The end result is a diminution or elimination of tackification of the exposed adhesive. The article upon use is burnished onto a substrate; subsequent removal of the carrier leaves the graphic design on the substrate while removing the adhesive not underlying the design due to this differential tackification.

U.S. Pat. Nos. 3,013,917 (Karlan et al.) and 4,111,734 (Rosenfeld) disclose dry transfer articles employing non-differentially tackified adhesives. The articles disclosed therein are made by printing ink on a low energy carrier to form a desired graphic pattern and overcoating the bottom side of the graphic pattern and the exposed portions of the carrier with an adhesive. Application to a substrate is provided by contacting the article to the substrate, applying pressure, and removing the carrier which desirably also removes the weed, i.e., non-image adhesive. When used with high dry tack adhesives, transfer articles comprising low energy carriers such as disclosed by Karlan and Rosenfeld typically do not reliably provide good weeding characteristics, i.e., the adhesive is not completely removed from the substrate. Therefore, such articles and typically require the use of low dry tack adhesives which in turn require high pressure or point pressure, i.e., 50 pounds/inch$^2$ or more, to achieve graphic transfer to the substrate. Also, these references teach that the graphic pattern is formed by applying ink to the carrier such that the ink wets out the carrier. Thus, the ink is printed in indirect fashion. Furthermore, such graphic patterns may tend to be difficult to separate from the carrier, thereby resulting in incomplete transfer to the substrate and/or spoiling of the finish of the transferred graphic pattern.

SUMMARY OF THE INVENTION

The present invention provides a transfer article which avoids the necessity of die- and/or kiss-cutting, i.e., is self-weeding; does not require modification of the adhesive layer, as by migrating components, photo exposure, etc., to effect satisfactory transfer; and yet achieves excellent weeding characteristics via an easy application technique that employs minimal pressure. The graphic pattern is an image that may be printed directly, rather than indirectly; may be printed by a number of techniques; and may be comprised of large designs or a number of small details including fine lines and half-tone dots. The transferred graphic or design may have a low profile, and is substantially devoid of resin or film between the elements of the design.

In accordance with the invention, there is provided a dry transfer article for application to a substrate to provide an image or design thereon, comprising a continuous carrier film presenting a suitable major surface having first and second surface portions thereon, a graphic pattern comprising at least one layer of an imaging material, the pattern being clingingly bonded to the first surface portions of the carrier film, and at least one continuous, non-actinic radiation-responsive adhesive layer, having first segments covering the graphic pattern on the first surface portions of the carrier, and bonded thereto, and second segments which cover the second surface portions of the carrier and are bonded thereto. The invention also provides a method for preparing such an article.

A suitable major surface is one which is compatible with the adhesive so as to achieve a strong bond therewith. Examples of compatible carrier surfaces include those having a microtextured surface wherein the surface area is preferably at least four times that of the carrier material's original non-textured surface wherein the polar component of the surface energy is at least about 20 ergs/cm$^2$; and those carriers which are chemically reactive with the adhesive.

To provide good separation, the graphic pattern and carrier surface are preferably substantially incompatible, developing, at most, a clinging bond. We have found that if the graphic pattern is provided by application of the imaging material to the adhesive, rather than to the carrier, that such a clinging bond may be provided with even high surface energy carriers.

The adhesive is compatible with, i.e, will bond strongly to, both the imaging material and graphic pattern formed therefrom, and, as described above, with the carrier. The adhesive should have a sufficiently low work to fracture such that under the dynamic conditions of peel following application of the transfer article to a substrate, the adhesive will preferentially fracture according to the edges or perimeter of the graphic pattern while the adhesive bond between the second segments of adhesive and the second surface portions of the carrier will remain intact, and the bond between the first segments of adhesive and the graphic pattern will also remain intact. Furthermore, the adhesive work to fracture should be sufficiently low that the applied adhesive bond between the adhesive underlying the graphic pattern and the substrate will remain intact. Also, the adhesive should not cohesively fail during the peel. Finally, the major surface of the carrier film should be capable of allowing or providing an adhesive bond to the second segments of the adhesive layer which is greater than the applied bond between the adhesive layer and the substrate. Accordingly, upon adhering the article to a substrate, the application of a peel force to the carrier film allows selective separation from the substrate of the carrier film, together with the second segments of the adhesive, along the edge of the graphic pattern, thus leaving on the substrate the graphic pattern and the first segments of adhesive in registry therewith.

The present invention provides a dry transfer article having numerous benefits relative to those cited in the patents noted above. Of greatest importance is an operative mechanism that does not rely on mechanisms or phenomena that are relatively difficult to control such as solvent or plasticizer migration, resin solvation and tackification, resin contraction or expansion, etc. In addition, manufacture of the article is simple relative to the articles and procedures noted above in that neither exposure to actinic radiation nor photosensitive resins are required; wet development is not required; and the printing sequence is direct, i.e., the same as that currently used to print adhesive-backed film. Other benefits which accrue from the avoidance of irradiative processes include the ability to use photosensitive inks and the ability to generate retroreflective dry transfer graphics.

The dry transfer article of the present invention achieves levels of performance, i.e., transfer of large graphics and of small graphics such as narrow lines, e.g., two line pairs per millimeter-width, and half-tone dots, e.g., 40 percent coverage of a 32 dot line count, with exceptional self-weeding characteristics and ease of application, that were heretofore typically unattainable by non-differentially-tackified adhesive layers, particularly without use of high lamination pressures or point pressures.

The dry transfer article of the present invention comprises an assemblage of elements which allows for the transfer of images to a substrate such that the resultant transferred images are devoid of resin or film between the elements of the images. Graphic materials and adhesives may be employed in the article which are capable of withstanding chemical and physical disruptive forces, especially in exterior usage where abrasive or environmental conditions are severe.

The method of use of the transfer article consists of application of the exposed adhesive against a substrate, typically with minimal pressure, e.g., simple hand pressure or burnishing by rubber squeegee, followed by removal of the carrier. This carrier removal, which is synonymous with physical development, affords simultaneous removal of the associated adhesive which is adhered to the exposed areas of the carrier, i.e., weeding. The graphic pattern, having minimal adhesion or cling to the carrier, remains securely attached to the substrate devoid of film or resin between the elements of the graphic design without the need for procedures to differentially detackify, or modify in some fashion, the adhesive that does not underlie the graphic design. The individual edges of the pattern are observed to be clean and sharp, i.e., fracture of the adhesive occurs along the edges of the graphic design. The differential transfer and adhesive fracture are of such a degree that fine lines and halftones are readily transferred. Transfer articles of the invention may be applied to many substrates, including glass, metal, and fabrics.

The method of preparing the dry transfer graphics article of the invention comprises:

(i) coating a release liner with an adhesive;

(ii) applying an imaging material in an imagewise fashion onto the surface of the adhesive, and forming the desired graphic pattern;

(iii) contacting the graphic pattern and the remaining exposed surface of the adhesive with a carrier sheet; and (iv) applying sufficient pressure and, if necessary, heat, to the carrier sheet to adhere the adhesive thereto.

In some embodiments, forming the graphic pattern may involve such operations as curing, drying, or fusing the imaging material, depending in part upon the nature of the imaging material. Preferably, the release liner is coated with a first layer of adhesive, such as a pressure-sensitive adhesive, and then a layer of a thermoplastic adhesive is coated thereover. As discussed below, such a thermoplastic adhesive layer is typically more easily printed upon than pressure-sensitive adhesives, yet provides the desired adhesion characteristics to the carrier.

BRIEF DESCRIPTION OF THE DRAWINGS

The invention is further explained and illustrated by reference to the drawing wherein.

The figures, which are not to scale, are intended to be merely illustrative and are not limiting.

DETAILED DESCRIPTION

The method for preparing a dry transfer article, as provided by the invention, comprises: (1) coating a release liner with at least one layer of adhesive; (2) applying in imagewise fashion at least one layer of an imaging material to the exposed surface of the adhesive, and forming a graphic pattern from the imaging material, the imaging material and adhesive being compatible such that a good bond between the graphic pattern and adhesive is provided; (3) contacting the graphic pattern and exposed surface of the adhesive with a carrier film having high compatibility with the adhesive and low compatibility with the graphic pattern; and (4) applying sufficient pressure, and if necessary, heat, to the carrier film to adhere the adhesive thereto.

It is a critical aspect of the present invention that imaging material be applied to the adhesive and that the graphic pattern be substantially formed therefrom, i.e., by drying, curing, fusing, etc., if necessary, depending upon the nature of the imaging material, such that a good bond be provided between the graphic pattern and adhesive but that the graphic pattern and carrier surface develop only a clinging bond. One manner of effecting this is to form the graphic pattern on the adhesive, e.g., drying an ink imaging material or fusing a toner powder imaging material with radiant heat so as to wet out the adhesive, before the carrier film is contacted thereto. Further, the application of pressure and heat, if any, to laminate the carrier and adhesive should be controlled to prevent the graphic pattern from softening sufficiently to wet out or otherwise substantially interact with the carrier film so as to develop more than a clinging bond thereto. We have found that if the imaging material is applied to carrier surfaces of the type disclosed herein and the graphic pattern formed thereon, in the manner of the prior art, that typically transfer of the graphic pattern to a substrate will not be achieved because the graphic pattern will not release from the carrier.

Accordingly, the sequence of preparation embodied in the method provided herein enables the employment of high surface energy carriers of a type previously unusable in transfer graphic articles because of the poor separation of graphic pattern and carrier provided by transfer graphic articles made according to the teachings of the prior art. Furthermore, with the present invention, more highly aggressive adhesives may be employed than previous teachings allowed.

Figure 1:
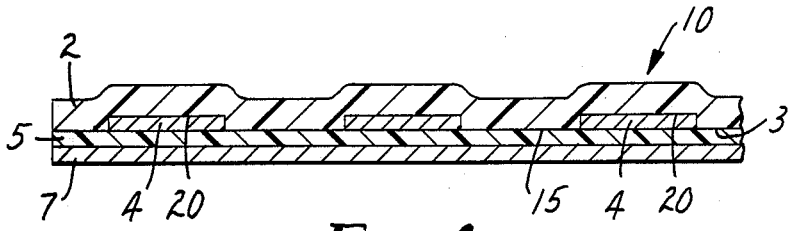
FIG. 1 is a cross-sectional view illustrating the assemblage of elements comprising the article prior to application to a substrate.

Referring to FIG. 1, article 10 includes a continuous carrier film 2 having a major surface 3 to which is minimally adhered, as at first surface portion 20, a graphic pattern 4 formed from a layer or layers of imaging material. A continuous layer of adhesive 5 adheres to and covers graphic pattern 4 and exposed or second surface portions of carrier surface 3, i.e., those areas (designated as 15) not covered by graphic pattern 4. Adhesive layer 5 is preferably protected by release liner 7 prior to use.

Figure 2:
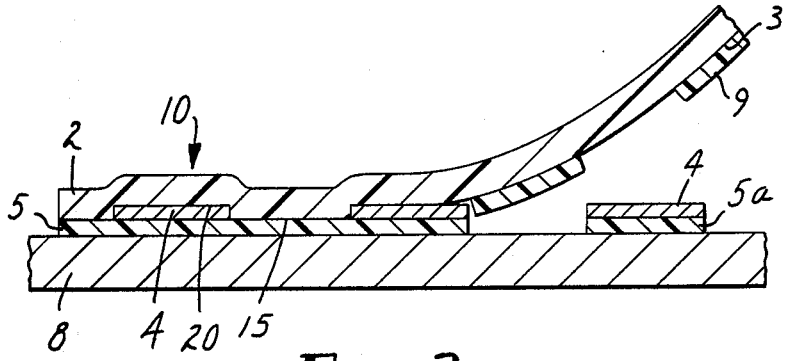
FIG. 2 is a cross-sectional view of the article of FIG. 1 applied to a substrate during the process of development wherein the carrier film and the non-imagewise adhesive are partially removed.

FIG. 2 illustrates the process of application and image transfer to a substrate. After removal of release liner 7, adhesive 5 is positioned onto substrate 8 and carrier 2 is burnished. As illustrated in FIG. 2, removal of carrier 2 allows transfer of graphic pattern 4 and associated adhesive 5*a* in registry therewith to substrate 8. Concomitantly, the non-image-associated adhesive 9 is strongly adhered to carrier 2 at second surface portion 15, and consequently removed from substrate 8, thereby producing image transfer which is devoid of adhesive between the numerics and/or graphics of graphic pattern 4.

The process of development of the invention is mechanical in nature and is dependent upon numerous forces within the various elements of the article. Henceforth, we define the interfacial adhesion between layers X and Y as IA (x,y), and the cohesive strength of graphic pattern 4 and adhesive 5 by $C_4$ and $C_5$, respectively. With this in mind, IA(2,5) should be sufficiently large to insure that separation or delamination of the layers 2 and 5 does not occur during development. Furthermore, the difference between IA(2,5) and applied IA(5,8) should be sufficiently large to prevent transfer of second adhesive segments (as at 15) to substrate 8.

Next, IA(2,4) should approximate cling adhesion, i.e, there should be a very low interfacial adhesion between graphic pattern 4 and the surface of carrier 2. However, IA(2,4) is preferably not essentially zero so as to prevent premature delamination of graphic pattern 4 from carrier 2 during preparation or transfer, particularly of relatively large graphic patterns.

Lastly, the work to fracture, which refers to the frangible nature of adhesive layer 5, should be low enough relative to applied IA(5,8), IA(4,5), IA(2,5) and $C_5$ that, upon carrier removal, as is illustrated in FIG. 2, fracture of adhesive 5 will occur at the edges or perimeter of graphic pattern 4 in preference to: cohesive delamination of adhesive 5; and failure at the interface between graphic pattern 4 and underlying adhesive 5*a*, the interface between adhesive 5*a* and substrate 8, or the interface between carrier second surface portions and second adhesive segments 9, as at 15. Adhesive layer 5 preferably has a work to fracture as hereinafter determined which is less than about 2000 cm-kg/cm$^3$, and more preferably has a work to fracture which is less than 700 cm-kg/cm$^3$.

With reference to the individual elements of our article, carrier film 2 is preferably transparent so as to assist in placement on substrate 8. Concomitantly, its dimensional stability must be such to withstand any thermal stresses incurred when thermal lamination is required. Examples of films meeting these criteria include polyesters such as polyethylene terephthalate; polyimides such as "Kapton"; polycarbonates such as "Lexan"; polyamides; and polyphenylene sulfide.

Major surface 3 of carrier 2, i.e., that surface which is laminated to adhesive 5 and graphic pattern 4 should be compatible with the adhesive and incompatible with the graphic pattern so as to provide the necessary bonding forces discussed above, i.e., a strong bond to adhesive 5 and a clinging bond to graphic pattern 4. Examples of compatible carrier surfaces include those having a microtextured surface wherein the surface area is preferably at least four times that of the carrier material's original non-textured surface area wherein the polar component of the surface energy is at least about 20 ergs/cm$^2$; and those which are reactive with the adhesive. The polar component of the surface energy of a carrier surface may be determined using advancing contact angle measurements of water and n-hexadecane as described by D. H. Kaeble in "Physical Chemistry of Adhesion", Wiley Interscience, 1971.

In some instances, major surface 3 may, during the manufacture of the carrier 2, attain satisfactory surface characteristics. For example, paper, e.g., papers sold under the tradenames MV or MLP by Schoeller Technical Paper Company, is one such carrier.

As is typically necessary, major surface 3 can be treated, as for example, by priming, to insure adequate interfacial adhesion between surface 3 and adhesive 5, while allowing minimal adhesion between graphic pattern 4 and surface 3. Such treatments or primes may vary considerably in chemistry and physical structure, depending in part upon the nature of the particular carrier, adhesive, and imaging material which are utilized. Examples of prime coats that have demonstrated utility include: bohmite (also known as boehmite); modified silica sol gel; thermally-cured aziridine coatings (useful as a reactive prime with adhesives possessing reactive carboxyl groups); and polyethyleneimine/epichlorohydrin condensation products. Other means of priming the carrier surface include sputter etching of the carrier surface in accordance with U.S. Pat. No. 4,340,276 (Maffitt et al.) or plasma treatment as disclosed by Souheng Wu., *Polymer Interface & Adhesion,* pgs. 298–336 (Marcel Deker, New York, N.Y. 1982).

Examples of carrier surfaces considered herein to be suitable are those which will develop an average peel force of at least about 3.0, and preferably at least 5.0, pounds/inch-width (0.5 and 0.9 kg/cm width, respectively) as determined according to the test procedure described below.

The carrier is preferably substantially free of or contains only limited quantities of additives that might bloom or migrate to the surface thereof and interfere with development of the desired bonds with the graphic and the adhesive.

Examples of useful imaging materials include inks, toner powders and the like, that can be applied to the surface of the adhesive in imagewise fashion, and are compatible therewith, i.e., will wet out or otherwise interact with the adhesive to bond thereto. For instance, toner power may be applied to the adhesive in imagewise fashion and fused to provide the desired graphic pattern. Inks used successfully include those having solvent-based polymeric binders such as urethanes, acrylics, vinyls, vinyl-acrylic blends, epoxies, and irradiative systems such as those which are actinic-radiation curable. Non-colored, i.e., clear imaging materials may be used, where desired, e.g., as protective top coats for colored imaging materials or to define the graphic patterns of transfer articles made with colored or pigmented adhesives.

Graphic patterns having protective clear coats in precise registration with an underlying colored layer may be desired for aesthetic reasons, i.e., a paint-like, unitary appearance which is provided. Such graphic patterns may also offer improved resistance to abrasive forces and to collection of unsightly foreign matter to the edges thereof. Transfer articles of the present invention comprising such graphic patterns may be provided by printing an ink on a thermoplastic adhesive layer, the ink wetting out the adhesive and forming a desired image thereon. A clear coating composition is then applied thereover, in substantial registration with the edges of the image but slightly, e.g., up to about 0.1 inch (2.5 millimeters), beyond the edges thereof, the composition being such as will wet out the previously formed image but will not wet out adhesive layer. Such coating composition will dewet or retract from the surface of the adhesive layer onto the image. Typically it is then dried and/or cured to provide a clear protective coating thereon having rounded edges and an appealing paint-like appearance.

It is noteworthy that the final thickness and integrity of the graphic pattern is not a significant contributor to the success of the transfer process, i.e., the graphic pattern need not be a unitary film of substantial structural strength and $C_4$ may be very low. Graphic patterns having a thickness as low as 0.005 millimeter, for example, as could be obtained by gravure printing, have been successfully transferred.

The adhesive layer is compatible with the imaging materials such that a good bond is provided between the graphic pattern 4 and adhesive 5, i.e., IA(4,5) is sufficient that graphic pattern 4 will release from carrier surface 3 and be retained on substrate 8 during transfer. For instance, if an ink is used as the imaging material, the adhesive should be such that the ink will wet out the surface thereof so as to develop a bond thereto and be retained thereon. The adhesive is also compatible with the surface of the carrier 2, i.e., capable of adhering to the carrier under laminating conditions. The adhesion between the carrier and the adhesive is preferably substantially greater than the applied adhesion between the adhesive and the substrate to which the graphic is to be applied.

A number of pressure-sensitive adhesives have been shown to work successfully including: acrylics; natural rubbers; block copolymers such as "Kratons", i.e., styrene-isoprene-styrene; and silicone adhesives such as polydimethylsiloxane and polymethylphenylsiloxane. These adhesives may incorporate additives such as ground glass, titanium dioxide, silica, glass beads, waxes, tackifiers, low molecular weight thermoplastics, oligomeric species, plasticizers, pigments, metallic flake, metallic powder, etc.

The surface of the adhesive which is to be applied to the substrate may be treated so as to permit repositioning of the transfer article on the substrate before a permanent bond thereto is achieved. Such adhesive characteristics can be achieved by providing a layer of minute glass bubbles on the surface of the adhesive, as disclosed in U.S. Pat. No. 3,331,729 (Danielson et al). Alternatively the adhesive may be such as to provide low initial adhesion and thereafter provide greater adhesion. An example of such adhesive is an isooctyl acrylate/acrylamide adhesive to the backbone of which is grafted a monovalent siloxane polymeric moiety having a number average molecular weight ("MW") between about 500 and 50,000, e.g., methacryloxypropyl-terminated polydimethyl siloxane.

The imaging material may be applied in imagewise fashion to the adhesive layer in any of a number of ways, e.g., screen printing, ink-jet printing, electronically, electrographically, electrophotographically, thermal mass transfer system, etc., depending in part upon the nature of the imaging material and of the adhesive layer. For instance, if adhesive layer 5 consists of a pressure-sensitive adhesive, it will typically be preferred to apply an ink imaging composition to the surface thereof via a nonimpact technique such as ink-jet printing in view of the difficulties presented when printing upon a tacky surface.

In view of the fact that numerous methods of application do not lend themselves to application of an imaging material to a tacky surface such as a layer of pressure-sensitive adhesive, adhesive layer 5 may comprise a layer of pressure-sensitive adhesive e.g., a second adhesive layer, that will contact substrate 8 covered by a layer of a thermoplastic adhesive, i.e., a first adhesive layer, that provides a substantially less tacky, more readily printed upon surface. Such dual-adhesive constructions thus provide the advantages both of readily printed-upon surfaces, and of easy application and adhesion to a substrate. In this case (not illustrated in the drawing), the interfacial adhesion between each adhesive layer must be as great or greater than applied IA(5,8), to assure that delamination of the various adhesive layers will not occur during physical development. The pressure-sensitive adhesive layer should provide an applied interfacial bond to substrate 8 exceeding that of graphic pattern 4 to first surface portion 20 of carrier 2. In general, the adhesion between the pressure-sensitive adhesive layer and substrate 8 must be less than the interfacial adhesion between the other adhesive layers of the article, between carrier 2 and thermoplastic layer, and between the thermoplastic layer and pressure-sensitive adhesive.

Exemplary resins that have been proven useful as thermoplastic adhesives include acrylics, polyvinylpyrrolidone, polyvinyl chloride/acetate (VYLF), polyvinyl acetyls, polyvinyl formals, polyurethanes, cellulose acetate butyrate, polyesters, polyamides, etc. These adhesives may incorporate additives such as cited above.

Alternatively, adhesive layer 5 may consist essentially of a thermoplastic adhesive. Application of such a transfer graphic article to a substrate typically includes the step of thermal activation of the thermoplastic adhesive The thermoplastic layer associated with this construction has a sufficiently low work to fracture, as hereinafter determined, coupled with the required adhesion during the laminating process, to provide excellent edge splitting and transfer results. It is preferred that the thermoplastic adhesive have a work to fracture of less than about 2000 cm-kg/cm$^3$, and more preferably less than about 700 cm-kg/cm$^3$.

An example of a useful embodiment of the present invention is a transfer graphic article comprising a thermoplastic adhesive wherein the imaging material is toner powder that is applied electrographically to the adhesive surface. The graphic pattern may be formed by heating the toner powder, e.g., with radiant heating means, to cause the toner powder to fuse, thereby forming a graphic pattern and wetting out the adhesive to provide a good bond thereto. Thereafter the carrier is laminated to the graphic pattern and adhesive with sufficient heat and pressure to activate the adhesive, causing it to bond to the carrier, but such heat being insufficient to cause the toner to bond to the carrier. In another embodiment, after application of the toner powder to the adhesive, the carrier may be contacted to the imaging material and adhesive, and the assembly laminated with heat and pressure, thereby activating the adhesive which thereupon bonds to both the toner powder and carrier. In each embodiment, however, care must be taken that the activation of the adhesive is performed at a temperature sufficiently low that the toner powder does not substantially soften and bond to the carrier.

The adhesive can comprise a multi-layered construction of these adhesives and/or resins, provided the required adhesion parameters are met. Furthermore, the adhesive need not be responsive to actinic radiation.

The properties of optional release liner 7 are such that, if used, it: offers protection to the pressure-sensitive adhesive; protects the article until intended transfer; and exhibits release characteristics such that its removal from adhesive layer 5 can be effected without damage to the article. Among liners that have proven particularly useful we cite those which are either resin or paper-based and have as their major surface a coating of silicone or polysilicones, fluorocarbons or polyfluorocarbons, waxes, polyolefins, etc.

Procedure for Determination of Carrier/Adhesive Compatibility

A layer of isooctyl acrylate/acrylic acid (90/10 weight ratio, inherent viscosity = 1.7 at 0.2 g/dl in ethyl acetate), a pressure-sensitive adhesive, is knotch bar coated onto a 4 mil (100 micrometer thick) polyester film primed with polyvinylidene chloride polymer latex to provide a 1.5 mil (38 micrometer) dry film thickness. A silicone protective liner is laminated to the adhesive surface and the laminate is cut into 1.0 inch wide (2.5 cm) strips. After removal of the silicone release liner, the strips are then individually laminated to the carrier surface to be tested using heated nip rollers under lamination conditions of 250° F. (120° C.) and 30 pounds/inch$^2$ ($2.1\times10^5$ N/m$^2$) at a speed of 25 inches (64 cm)/minute. The test samples are allowed to set for a dwell time of 30 minutes at room temperature, and then mounted on an I-Mass test unit in such a manner as to provide a 180 degree peel back of the carrier from the test strip at a rate of 90 inches (2.3 m)/minute as the average peel values are recorded.

The results provided by several different carrier materials having different surface properties are tabulated below.

| Table I Carrier Material | Surface Treatment | Average Peel Force[3] (Pounds/ Inch-width) | | Compatible (Yes/No) |
|---|---|---|---|---|
| Polyester | Sputter-etched | 7.8[2] | [1.4] | Yes |
| Polyester | Boehmite | 11.1[2] | [2.0] | Yes |
| Polyester | Aziridine | 4.3[2] | [0.77] | Yes |
| Polyester | Sol-gel | 5.5[1] | [0.98] | Yes |
| Polyester | None | 0.8 | [0.14] | No |
| Polystyrene | None | <0.1 | [<0.02] | No |
| Polypropylene | None | <0.1 | [<0.02] | No |

[1]Slight Cohesive Failure
[2]Cohesive Failure
[3]Quantities in brackets [] are expressed in kg/cm-width As shown by these results, untreated polyester, untreated polystyrene, and untreated polypropylene are considered to be incompatible with this adhesive for the purposes of this invention. A relative sense of the magnitude of the strength of the bond obtained between the adhesive and the compatible carriers is provided when it is noted that when this test was performed substituting a piece of etched and anodized aluminum for the carrier, the resultant average peel force was determined to be about 6.8 pounds/inch-width (1.2 kg/cm-width) with very slight cohesive failure.

Procedure for Determination of Work to Fracture

The resin of interest is dissolved in an appropriate solvent and knife coated onto a 200 micron silicone coated polyethylene/paper laminate release liner (tradename Polyslik, available from The James River Corp.). The solvent is driven off by air drying 24 hours at ambient conditions, and if necessary, the resulting film is repeatedly overcoated so as to achieve a dried film of approximately 150 micron thickness. The procedure for drying the film consists of air drying for a minimum of two weeks under ambient conditions followed by one hour at 65° C. The film is removed from the liner, cut into one-inch strips, conditioned at 50% relative humidity and 22° C. for 24 hours, and subjected to tensile testing using an Instron, with a grip separation based on a sample length of two inches; crosshead speed of 30 cm/min; room humidity and temperature of 50% and 22° C. From the data obtained a complete stress/-strain curve is drawn, and the area under the curve is then calculated and reported as work to fracture.

To more specifically illustrate the invention, the following non-limiting examples were prepared, wherein all parts are by weight unless otherwise specified.

The following abbreviations are used in the examples:

AA—acrylic acid
ACM—acrylamide
GMA—glycidyl methacrylate
HEA—hydroxyethyl acrylate
IOA—isooctyl acrylate
MBA—methylbutyl acrylate
NVP—N-vinylpyrrolidone
OACM—octylacrylamide (tradename used by Proctor Chemical Co. for a composition containing N-(1,1,3,3-tetramethyl-n-butyl-acrylamide)
PET—polyethylene terephthalate
VA—vinyl acrylate

EXAMPLE 1

Onto the surface of a 200 micron silicone coated polyethylene/paper laminate release liner (tradename Polyslik, available from the James River Corp.) was knife coated (dry coating weight of 12.5 g/m$^2$) a layer of the following resin: IOA/AA (95.5/4.5 weight ratio); 22 weight percent solids in isopropanol/heptane; inherent viscosity of 1.6 at 0.2 g/dl in ethyl acetate.

In nearly identical fashion, the above layer was overcoated with a thermoplastic adhesive layer (dry coating weight of 4.2 g/m$^2$) of the following composition: IOA/OACM/AA (50/37/13 weight ratio); 20 weight percent solids in ethyl acetate; inherent viscosity of 0.6 at 0.2 g/dl in ethyl acetate. This thermoplastic adhesive has a work to fracture of about 125 cm-kg/cm$^3$.

An ER-102 Fire Red Epoxy Resin Ink (commercially available from Naz Dar) was screen printed onto the thermoplastic layer using a 157 mesh screen to provide an ink film having a 30 micron dry thickness. The ink was cured to specifications to form the graphic pattern and the resulting printed article was laminated to a bohmite-primed 100 micron polyester carrier film. Lamination was effected by use of pressurized, heated nip rollers (130° C.; 75 cm/min.; and 2.1 kg/cm$^2$).

Application of the transfer graphic involved removal of the release liner, followed by application of the pressure-sensitive adhesive layer by burnishing or rubbing against a glass plate. Removal of the carrier effected physical development, i.e., substantially all the adhesive not associated with the graphic pattern was retained by the carrier whereas the graphic pattern with its associated adhesives remained adhered to the substrate. Similar graphics were successfully transferred to other substrates including: metal; paint; plastic films such as PVC, polyester, etc.; wood; etc.

EXAMPLES 2–13

The procedure described in Example 1 was repeated using the following for the pressure-sensitive adhesive, with similar results being obtained: (In each, the ratios in parenthesis are the weight ratios of the components of the adhesives; and IV is inherent viscosity, which provides an indication of cohesive strength and frangibility, i.e., increasing inherent viscosity tends to indicate increased cohesive strength and decreased frangibility.)

| Example | Pressure-Sensitive Adhesive Composition |
|---|---|
| 2 | IOA/ACM (96/4); IV:1.46 (at 0.2 g/dl in ethyl acetate) |
| 3 | IOA/GMA/NVP (70/15/15); IV:0.78 (at 0.2 g/dl in ethyl acetate) |
| 4 | IOA/GMA/ACM (80/15/5); IV:0.67 (at 0.2 g/dl in ethyl acetate) |
| 5 | IOA/AA (90/10); IV:1.7 (at 0.2 g/dl in ethyl acetate) |
| 6 | 2MBA/ACM (96/4); IV:0.62 (at 0.2 g/dl in ethyl acetate) |
| 7 | IOA/MA/ACM/GMA/HEA (63/25/1.5/10/0.5); IV:0.9 (at 0:2 g/dl in ethyl acetate) |
| 8 | 2MBA/AA (90/10); IV:0.7 (at 0.2 g/dl in ethyl acetate) |
| 9 | IOA/NVP/HEA (89/10/1.0); IV:0.8 (at 0.2 g/dl in tetrahydrofuran) |
| 10 | IOA/AA (94/6 with 40% Foral); IV:1.52 (at 0.2 g/dl in water) |
| 11 | IOA/AA (95.5/4.5); IV:1.60 (at 0.2 g/dl in water) |
| 12 | IOA/VA/AA (74/22/4); IV:1.38 (at 0.2 g/dl in ethyl acetate) |
| 13 | A polymethylphenyl siloxane available from General Electric Company under the tradename PSA-518. |

EXAMPLES 14–23

The procedure in Example 1 was repeated using the following resins for the layer of thermoplastic adhesive, with similar results being obtained:

| Example | Thermoplastic Adhesive Composition |
|---|---|
| 14 | A polyamide resin available from Union Camp under the tradename Unirez 2641. |
| 15 | A polyamide resin available from Union Camp under the tradename Unirez 2645. |
| 16 | A polyamide resin available from Union Camp under the tradename Unirez 2646. |
| 17 | A urethane resin available from Lord Corp. under the tradename Tycel TM 7000. |
| 18 | IOA/OACM/AA (72/20/8) plus a terpene resin available from Hercules Corporation under the tradename Picco 6100 (1:1 weight ratio). |
| 19 | An acrylic polyol available from Rohm & Haas Company under the tradename Acryloid AU 608X. |
| 20 | A polyester polyol available from Mobay Chem. Corp. under the tradename Desmophen 651-65-PMA. |
| 21 | An acrylic polyol available from Cellanese Corp. under the tradename Polytex 970. |
| 22 | IOA/OACM/AA (50/37/13) and a polymethylmethacrylate available from Dupont under the |

-continued

| Example | Thermoplastic Adhesive Composition |
|---|---|
| 23 | tradename Elvacite 2010 (1:1 weight ratio). IOA/OACM/AA (72/20/8) and a fine particle silica available from SCM Corporation under the tradename Silcron G-610 (a weight ratio of 30:1, respectively). |

EXAMPLES 24–30

The procedure of Example 1 was repeated using the following resins for the thermoplastic layer with the exception that the lamination was effected using an HIX-HT-400 flat bed laminator with a lamination time of 1 minute at 177° C. Similar results were achieved.

| Example | Thermoplastic Adhesive Composition |
|---|---|
| 24 | A polyvinyl butyral available from Monsanto Company under the tradename Butvar B-79. |
| 25 | A polyvinyl pyrrolidone available from the GAF Corp. under the designation NP-K30. |
| 26 | A vinyl chloride/vinyl acetate copolymer (88/12 weight ratio) available from the Union Carbide Corp. under the trade designation VYLF. |
| 27 | A polyvinyl formal from Monsanto Company under the tradename Formvar 5/95E. |
| 28 | A polyvinyl formal as in Example 29 having the tradename Formvar 15/95E. |
| 29 | A polyvinyl formal as in Example 28 having the tradename Formvar 71/95E. |
| 30 | Cellulose acetate butyrate available from Eastman Chemical Products, Inc. under the trade designation 551-0.2. |

EXAMPLES 31–35

The procedure of Example 1 was repeated using the ink systems listed below as the imaging material. Similar results were achieved.

| Example | Imaging Material |
|---|---|
| 31 | A urethane ink having the following components: 13.06 weight percent of Desmodur N-100 (a polyfunctional aliphatic isocyanate from Mobay Chemical); 1.0 weight percent of Multiflow (a 50% solids acrylic resin solution from Monsanto); 18.80 weight percent of butyl cellosolve acetate; 11.0 weight percent of Dipropylene Glycol Monomethyl Ether Acetate (from Dow Chemical); 7.6 weight percent of Phthalocyanine Blue BT-417D (from DuPont); 48.04 weight percent of Desmophen 651-A-65 (a polyester resin from Mobay). |
| 32 | A vinyl ink comprising Vinyl Resin-VYNS (10); Dioctyl Phthalate (3); Cadmium Red Pigment (40); Cyclohexanone (12.75); and Silicone Solution (0.25). |
| 33 | A medium oil alkyd ink available from KC Coatings under the tradename Enamel Plus Gloss Enamel Ink Series. |
| 34 | A lacquer ink as represented by Naz Dar's IL Series Industrial Lacquers. |
| 35 | An ultraviolet cured or hardened ink as represented by KC Coatings PSST-24 Black. |

EXAMPLE 26

The procedure of Example 1 was repeated with the following exceptions: (1) the thermoplastic layer comprised IOA/OACM/AA (70/20/8 by weight), 20 weight percent solids in ethyl acetate, inherent viscosity of 1.63 at 0.2 g/dl in ethyl acetate, and (2) the carrier film was a 100 micron PET film that was primed with a 110–120 nanometer coating of boehmite ($Al_2O_3.H_2O$). Similar results were achieved.

EXAMPLES 37–39

The procedure of Example 36 was repeated wherein following primed polyesters were substituted for the carrier:

| Example | Carrier |
|---|---|
| 37 | Polyethyleneimine/epichlorohydrin coated 76 micron PET. |
| 38 | Sputter etched 100 micron PET. |
| 39 | Oxygen plasma treated 100 micron PET. |

Similar results were achieved.

EXAMPLE 40

The procedure of Example 1 was repeated with the exception that a coating of Naz Dar No. ER 170 Gloss Clear (Epoxy Resin Ink) was screened in register onto the already cured Naz Dar Ink. Caliper of the clear coat after drying and curing was 5 microns. Upon transfer to a glass plate excellent weeding was achieved, i.e., all non-imagewise adhesive was removed with the carrier whereas the clearcoat, ink, and associated adhesive were retained by the substrate. As in Example 1, the elements of the image were observed to have clean, sharp, edges, i.e., selective cleaving of the adhesive and resin occurred along the outline of the image.

EXAMPLES 41–42

The procedure of Example 1 was repeated with the exception that the thermoplastic adhesive was imaged by the following means:

| Example | Imaging Technique |
|---|---|
| 41 | By burnishing using 3M Brand Transfer Letters (for projection transparencies and the graphic arts). |
| 42 | By using a (Sanford's) Sharpie black pen. |

Results were successful as for Example 1.

EXAMPLE 43

Example 1 was repeated with the exception that the imaging material was a screen printed slurry of the following composition:

10.7 g of Desmodur N-100;
8.6 g of Desmophen 670-90;
10.7 g of Desmophen 651-65A;
15.0 g of glass beads (Strado beads, 2.26 R.I., 5.51 g/cm$^3$, median diameter range of 66–74 micron.

The slurry was diluted with ethyl-3-ethoxy-propionate and printed using a 100 mesh screen; the resulting image was dried and cured for one hour at 90° C.

The article was laminated as described in Example 1. Transfer graphics produced in this manner were successfully transferred to substrates such as glass, aluminum, painted metal, etc., good self-weeding being achieved. The transferred images were retroreflective.

EXAMPLE 44

Example 1 was repeated with the exception that the thermoplastic resin was imaged by an ink-jet printer using an ink commercially available as No. 16-2200 from Videojet Systems International. The ink was UV radiation cured in accord with specifications. A conventional continuous ink jet unit was used, operating in the binary mode with uncharged drops printed. Transfer results similar to Example 1 were obtained.

EXAMPLE 45

Example 44 was repeated with the exception that only a pressure-sensitive adhesive was used, and of composition IOA/AA (95.5/4.5 weight ratio). Transfer results similar to Example 1 were obtained.

EXAMPLE 46

Onto the surface of a 150 micron silicone coated polyethylene/paper laminate release liner (tradename Acrosil BL-64-MF 12/10 Silox 1T/1T) was knotch bar coated with a thermoplastic resin IOA/OACM/AA (50/37/13 weight ratio) to a dry coating weight of 29.4 g/m$^2$. The drying condition for the solution-coated thermoplastic resin was 10 minutes at 65° C.

A urethane ink, based on Example 31, was screen printed using a 157 mesh screen. The ink was cured for 2 house at 80° C., and the resulting article was laminated to bohmite-primed 100 micron polyester film. Lamination was effected by use of pressurized, heated nip rollers (130° C., 75 cm/min, 2.1 kg/cm$^2$).

Application of the graphic involved removal of the release liner, followed by a hot lamination to Scanamural® white canvas that is 100% cotton and has a fine canvas texture. Lamination was effected by use of a HIX-HT-400 flat bed laminator for 30 seconds at 175° C.

The bohmite-primed polyester film was immediately removed (while hot) to effect physical development, i.e., all non-image associated thermoplastic resin was retained by the carrier (bohmite-primed polyester film) and the ink with its associated thermoplastic resin was attached to the white canvas.

EXAMPLE 47

The procedure of Example 1 was repeated with the exception that the image was screen printed using the urethane ink of Example 31 and a 20 lb. white bond paper was used as the carrier film. Transfers were effected on clear acrylic panels and polypropylene film, providing similar results as in Example 1.

EXAMPLE 48

A transfer graphic article was made as described in Example 31.

After the carrier film was laminated, the release liner was removed, and hollow glass bubbles approximately 40 microns in diameter were blown across the exposed surface of the adhesive.

When applied to a glass substrate, the transfer graphic exhibited low adhesion to the substrate and could be moved from place to place on the substrate.

Permanent bonding of the graphic pattern was provided by burnishing the article with a squeegee, thereby rupturing the glass bubbles and providing greater contact between the pressure-sensitive adhesive and glass surface.

Removal of the carrier effected physical development and complete weeding as in Example 1.

EXAMPLE 49

Onto the surface of a 200 micron silicone coated polyethylene/paper laminate release liner (tradename Poly Slik, available through the James River Corporation) was knife coated a layer of IOA/AA (95.5/4.5 weight ratio) at 22 weight percent solids in isopropanol/heptane to leave a film having a dry thickness of 40 microns. The resin has an inherent viscosity of 1.6 at 0.2 g/dl in ethyl acetate.

The layer of adhesive was overcoated with a reflective thermoplastic adhesive layer (dry coating thickness 20 microns) of 1 part by weight IOA/OACM/AA (50/37/13 weight ratio) and 3 parts by weight bismuth-/titanium beads (270/325 mesh as described in U.S. Pat. No. 4,192,576 claims 2 and 5) at 20 weight percent solids in ethyl acetate.

After the reflective layer was dried, it was overcoated with a layer of IOA/OACM/AA (50/37/13 weight ratio) to a dry coating thickness of about 15 microns.

A transparent ink, Scotchlite 4412 (commercially available from 3M), was screen printed onto the above thermoplastic layer using a 225 mesh screen to provide a 10 micron dry film thickness.

The ink was cured to specifications to form the graphic pattern and the resulting printed article was laminated to boehmite-primed 100 micron polyester film. Lamination was effected by use of pressurized, heated nip rollers (130° C.; 75 cm/min; and 2.1 Kg/cm$^2$).

Application of the graphic involved removal of the release liner, followed by application of the psa layer against an aluminum panel and burnishing with a rubber squeegee. Removal of the carrier effected physical development and described in Example 1. The resulting graphic pattern was retroreflective.

EXAMPLE 50

The procedure described in Example 1 was repeated using an adhesive of the following composition: IOA/ACM (96/4 weight ratio) grafted with 5 weight percent of a 10,000 MW methacryloxypropyl-terminated polydimethyl siloxane.

The adhesive provides low adhesion upon initial contact, allowing repositioning of the graphic on the substrate. Upon being burnished a stronger bond is provided. Removal of the carrier effected physical development and effective weeding.

EXAMPLE 51

A release liner coated with a pressure-sensitive adhesive was prepared as described in Example 1. Using a knotch bar coater, a layer of black pigmented thermoplastic adhesive was coated over the pressure-sensitive adhesive at a dry thickness of 1.5 mils (38 micrometers). The composition of the thermoplastic adhesive was as follows:

| Component | Amount |
|---|---|
| IOA/OACM/AA-(50/37/13) at 20 weight percent solids | 50 |
| Black millbase - polyester polymeric plasticizer, Ba/Zn liquid soap stabilizer, carbon black pigment (68/8/24) | 4.2 |
| Ethyl Acetate | 3.1 |

After coating, the structure was dried in a forced air oven for 30 minutes at 150° F. (65° C.).

The dried thermoplastic surface was screen printed with Scotchcal Brand UV Clear Printing Ink 9600-20, available from 3M, using a 280 mesh screen. The clear coat was then cured in a nitrogen atmosphere using a Linde Photocure System PS-2800 unit, available from Union Carbide, with medium mercury lamps and a defocused reflector for an output ranging between 150 and 500 mj/cm$^2$.

A carrier film was then laminated to the printed article as described in Example 1. When applied to a substrate as in Example 1, a black graphic pattern having the shape of the clear coat was transferred. The transfer process yielded a graphic pattern having sharply defined edges and excellent weeding characteristics.

EXAMPLES 52–53 AND COMPARATIVE EXAMPLE A–J

Examples 52–53 and Comparative Examples A–J were prepared to illustrate the differences in performance of transfer graphic articles made according to different methods of manufacture and using carriers having different surface properties.

Graphics were prepared in each example by coating the indicated adhesive on a silicone-treated paper release liner and drying. An image of the indicated ink was printed on either the surface of the adhesive or the carrier, as indicated, cured according to specifications to form a graphic pattern, and then the carrier and adhesive were laminated together as described in Example 1. Samples of each graphic were then applied to glass and painted metal surfaces, and the carrier stripped away to attempt or achieve transfer.

The results were as follows:

TABLE II

| Example | Carrier | Ink | Imaged Surface | Surface Adhesive[1] | Results |
|---|---|---|---|---|---|
| 52 | Sputter-etched Polyester | UV Ink[6] | Adhesive | IOA/OACM/AA[4] (IOA/AA[2]) | Excellent Image Transfer: No Carrier-Adhesive Delamination |
| 53 | Sputter-etched Polyester | UV Ink[6] | Adhesive | IOA/OACM/AA[4] (IOA/AA/ Siloxane[3]) | Excellent Image Transfer: No Carrier-Adhesive Delamination |
| A | Biaxially-oriented Polypropylene (untreated) | Naz Dar GV | Carrier | IOA/AA[2] | Complete Image Transfer: Complete Carrier-Adhesive Delamination |
| B | Biaxially-oriented Polypropylene (untreated) | Naz Dar GV | Carrier | IOA/AA/Siloxane[3] | Complete Image Transfer: Complete Carrier-Adhesive Delamination |
| C | Polyster (untreated) | Naz Dar GV | Carrier | IOA/AA[2] | Partial Image Transfer With Tearing; No Carrier-Adhesive Delamination |
| D | Polyester (untreated) | Naz Dar GV | Carrier | IOA/AA/Siloxane[3] | No Image Transfer |
| E | Polyester (untreated) | UV Ink[6] | Adhesive | IOA/OACM/AA[4] (IOA/AA[2]) | Image Transfer: Complete Carrier-Adhesive Delamination |
| F | Polyester (untreated) | UV Ink[6] | Adhesive | IOA/OACM/AA[4] (IOA/AA/ Siloxane[3]) | Image Transfer; Complete Carrier-Adhesive Delamination |
| G | Polyester (untreated) | Vinyl Ink[7] | Carrier | 2MBA/AA[5] | Partial Image Transfer With Tearing; Complete Carrier-Adhesive Delamination |
| H | Sputter-etched Polyester | Vinyl Ink[7] | Carrier | 2MBA/AA[5] | No Image Transfer |
| I | Boehmite-treated Polyester | Vinyl Ink[7] | Carrier | 2MBA/AA[5] | No Image Transfer |
| J | Sputter-etched Polyester | UV Ink[6] | Carrier | IOA/OACM/AA[4] (IOA/AA[2]) | No Image Transfer; No Carrier-Adhesive Delamination |

[1]Refers to adhesive which is in contact with carrier and indicia. Some of the graphics also comprised an additional layer of adhesive disposed between the surface adhesive and substrate. The presence of such additional layer is indicated by an entry in parentheses.
[2]IOA/AA (Weight ratio 95.5/4.5)-high wet grab
[3]IOA/AA/Siloxane (Weight ratio 83.0/7.0/10.0)-low initial adhesion, 13,331 MW methacryloxypropyl-terminated polydimethyl Siloxane.
[4]IOA/OACM/AA (Weight ratio 50.0/37.0/13.0)-thermoplastic.
[5]2MBA/AA (Weight ratio 90.0/10.0)-builds high adhesion with dwell time.
[6]Ultraviolet curable ink comprising (amount in parenthesis): Urethane/Acrylate Oligomer (16); Medium Krolar Yellow (23); Alpha,Alpha-Dimethoxy-Alpha-Phenylacetophenone (1.5); Benzophenone (1.5); 4,4'-Bis(dimethylamino)-benzophenone (0.5); N-Vinyl-2-Pyrrolidone (10); N-Isobutoxymethyl Acrylamide (32); Tetraethylene Glycol Diacrylate (15.5).
[7]Same ink as used in Example 32.

The present invention relates to a transfer graphic article which differs from those disclosed in the prior art in the manner or method by which it is manufactured, and in the properties of the carrier which is used. Important distinctions between the present invention and the prior art are understood by evaluating the results of the examples as follows:

As shown by Examples 52 and 53, a graphic article comprising a high energy carrier wherein the graphic pattern was formed on the thermoplastic adhesive provided excellent results, i.e., complete image transfer and complete weeding. However, a graphic article comprising the same carrier, ink, and adhesive, but wherein the graphic pattern was formed on the carrier as taught in the prior art did not provide satisfactory results as the image did not transfer, as shown in Comparative Example J.

Comparative Examples A–D, H and I were all made by forming the graphic pattern on the carrier. In Comparative Examples A and B, a biaxially-oriented polypropylene carrier having no surface treatment was used and provided complete image transfer, but provided no weeding as the adhesive completely delaminated from the carrier. In Comparative Example C, a graphic article comprising an untreated polyester carrier achieved substantial weeding, however, the image was torn by the physical development process and only partial transfer of the graphic pattern was achieved. In Comparative Example D, no image transfer was obtained, i.e., the graphic pattern did not separate from the carrier. In Comparative Examples H and I, transfer articles comprising high surface energy carriers wherein the graphic pattern had been formed on the carrier provided no image transfer.

In Comparative Examples E, F, and G, transfer graphic articles comprising untreated polyester carriers failed to provide satisfactory weeding in each case, and provided only partial image transfer in Comparative Example G when the graphic pattern was formed on the carrier.

EXAMPLE 54

A pressure sensitive adhesive was coated on a release liner as described in Example 1. Final coating weight was approximately 18 grains/foot$^2$.

A thermoplastic adhesive comprising 50 parts of IOA/OACM/AA (50/37/13 weight ratio; IV:1.2 at 0.2 g/dl in ethyl acetate) and 5 parts of IOA/AA/Siloxane (83/7/10 weight ratio; siloxane was methacryloxypropyl-terminated polydimethyl siloxane, 13,331 MW) was knife bar coated onto the layer of pressure-sensitive adhesive and dried at 150° F. (65° C.). Final coating weight was approximately 9 grains/foot$^2$.

An ultraviolet radiation-curable ink was screen printed on the layer of thermoplastic adhesive in imagewise fashion. The composition of the ink was as follows:

| Component | Amount |
|---|---|
| Urethane/Acrylate Oligomer | 9.5 |
| Heliogen K8683-green pigment | 3.5 |
| Drakenfeld 10342 | 13.0 |
| N-Isobutoxymethyl Acrylamide | 19.0 |
| 2-(2-Ethoxy-Ethoxy-)Ethyl Acrylate | 9.5 |
| VYHH-vinyl resin | 5.0 |
| N-Vinyl-2-Pyrrolidone | 16.5 |
| Alpha,Alpha-Dimethoxy-Alpha-Phenylacetophenone | 6.5 |
| 4,4-Bis(dimethylamino)-Benzophenone | 0.4 |
| Benzophenone | 1.3 |
| Tinuvin 292 | 0.8 |
| Ethyl Acrylate/2-Ethylhexyl Acrylate Copolymer | 1.3 |
| Dipentaerythrital Monohydroxypenta Acrylate | 13.7 |

After printing, the graphic pattern was cured in a nitrogen atmosphere as described in Example 51.

A clear coat composition was then printed over the cured ink, in substantial registration therewith, but slightly (i.e., about 1.5 mm) beyond the edge definition thereof. The clear coat composition was as follows:

| Component | Amount |
|---|---|
| Urethane/Acrylate Oligomer | 47.0 |
| N-Isobutoxymethyl Acrylamide | 10.0 |
| 2-(2-Ethoxy-Ethoxy-)Ethyl Acetate | 10.0 |

-continued

| Component | Amount |
|---|---|
| 1,6-Hexanediol Diacrylate | 5.0 |
| N-Vinyl-2-Pyrrolidone | 14.0 |
| Dipentaerythrital Monohydroxypenta-Acrylate | 9.0 |
| Ethyl Acrylate/2-Ethylhexyl Acrylate Copolymer | 1.3 |
| Diethoxy Acetophenone | 2.7 |
| Tinuvin 292 | 1.0 |

After being allowed to sit at room temperature for a few minutes the clear coat dewetted from the surface of the thermoplastic adhesive, retreating to the surface of the cured ink design into precise registration therewith. The clear coat was then cured in the same manner as the ink. The graphic pattern had a paint-like appearance.

It is believed that the resulting printed article could be laminated to a carrier and transferred to a substrate as in Example 1. The resultant transferred design would have a paint-like appearance.

Various modifications and alterations of this invention will become apparent to those skilled in the art without departing from the scope and spirit of this invention.

What is claimed is:

1. A dry transfer article for application to a substrate to provide a design thereon comprising:

(1) a continuous carrier film presenting a major surface having first and second surface portions thereon;

(2) a graphic pattern in the shape of said design, said graphic pattern comprising at least one layer and being clingingly bonded to said first surface portions of said major of said carrier film; and (3) at least one continuous adhesive layer having first segments covering said graphic pattern and bonded thereto, and second segments covering said second surface portions of said major surface of said carrier and bonded thereto;

said major surface of said carrier film exhibiting sufficiently high compatibility with said adhesive to provide a strong bond therebetween;

said major surface of said carrier film exhibiting sufficiently low compatibiity with said graphic pattern to provide at most a clinging bond therebetween;

said graphic pattern having been formed from at least one layer of an imaging material applied to said adhesive before said carrier was contacted thereto;

wherein the work to fracture of said adhesive layer is sufficiently low that, upon application of a peel force to said carrier, said adhesive will preferentially fracture according to the edges of said graphic pattern while the bond between said second segments of said adhesive and said second surface portions of the carrier and the bond between said first segments of said adhesive and said graphic pattern will remain intact; and wherein said major surface of said carrier film is primed with at least one of the following: bohmite, sputter etch, oxygen plasma treatment, or modified sol gel, such that said major surface is capable of providing an adhesive bond to said second segments of said adhesive layer which is greater than the applied adhesive bond between said adhesive layer and said substrate;

whereby, upon adhering said article to said substrate, application of a peel force to said carrier film allows selective separation from said substrate of said carrier film together with said second segments of said adhesive along the edge of said graphic pattern, leaving on said substrate said graphic pattern, and said first segments of said adhesive in registry therewith.

2. The article of claim 1 wherein said adhesive has a work to fracture of less than about 2000 cm-Kg/cm$^3$.

3. The article of claim 2 wherein said adhesive has a work to fracture of less than 700 cm-kg/cm$^3$.

4. The article of claim 1 wherein said adhesive is non-responsive to actinic radiation.

5. The article of claim 1 wherein said adhesive comprises a thermoplastic resin.

6. The article of claim 1 wherein said adhesive comprises a normally tacky pressure-sensitive adhesive.

7. The article of claim 1 wherein said carrier is paper.

8. The article of claim 1 wherein said major surface of said carrier has a microtextured surface such that the effective surface area is at least four times that of carrier material's original non-textured surface area, and wherein the polar component of the surface energy is at least about 20 ergs/cm$^2$.

9. The article of claim 1 wherein said major surface of said carrier is primed.

10. The article of claim 9 wherein said prime is bohmite.

11. The article of claim 9 wherein said prime is based on a sputter etch.

12. The article of claim 9 wherein said prime is based on oxygen plasma treatment.

13. The article of claim 9 wherein said prime is a modified sol gel.

14. The article of claim 1 wherein said major surface of said carrier is chemically reactive with said adhesive.

15. The article of claim 14 wherein said major surface of said carrier comprises a thermally-cured aziridine coating and said adhesive possesses reactive carboxylic groups.

16. The article of claim 1 further comprising a release liner in contact with said adhesive.

17. The article of claim 1 wherein said imaging material comprises an ink.

18. The article of claim 1 wherein said imaging material comprises toner powder.

19. The article of claim 1 where said graphic pattern comprises a clear protective coating and at least one colored layer, said protective coating being in precise registration therewith.

20. A dry transfer article for application to a substrate to provide a design thereon comprising:

(1) a continuous carrier film presenting a major surface having first and second surface portions thereon;

(2) a graphic pattern in the shape of said design, said graphic pattern comprising at least one layer and being clingingly bonded to said first surface portions of said major surface of said carrier film; and (3) a continuous adhesive layer comprising a first continuous layer of adhesive having first segments covering said graphic pattern and bonded thereto, and second segments covering said second surface portions of said major surface of said carrier and bonded thereto, and a second continuous layer of adhesive that covers said first layer of adhesive whereby said first layer of adhesive is disposed between said second layer of adhesive and said graphic pattern;

said major surface of said carrier film exhibiting sufficiently high compatibility with said first layer of adhesive to provide a strong bond therebetween;

said major surface of said carrier film exhibiting sufficiently low compatibility with said graphic pattern to provide at most a clinging bond therebetween;

said graphic pattern having been formed from at least one layer of an imaging material applied to said adhesive before said carrier was contacted thereto;

wherein the work to fracture of said adhesive layer is sufficiently low that, upon application of a peel force to said carrier, said adhesive will preferentially fracture according to the edges of said graphic pattern while the bond between said second segments of said first layer of adhesive and said second surface portions of the carrier and the bond between said first segments of said first layer of adhesive and said graphic pattern will remain intact; and wherein said major surface of said carrier film is capable of providing an adhesive bond to said second segments of said adhesive layer which is greater than the applied adhesive bond between said adhesive layer and said substrate;

whereby, upon adhering said article to said substrate, application of a peel force to said carrier film allows selective separation from said substrate of said carrier film together with said second segments of said adhesive layer along the edge of said graphic pattern, leaving on said substrate said graphic pattern, and said first segments of said adhesive layer in registry therewith.

21. The article of claim 20, wherein at least said first layer of adhesive comprises a thermoplastic resin.

22. The article of claim 20 wherein at least said second layer of adhesive comprises a normally tacky pressure-sensitive adhesive.

* * * * *

UNITED STATES PATENT AND TRADEMARK OFFICE

CERTIFICATE OF CORRECTION

PATENT NO. : 4,919,994

DATED : April 24, 1990

INVENTOR(S) : Joseph H. Incremona et al.

It is certified that error appears in the above-identified patent and that said Letters Patent is hereby corrected as shown below:

On the front page, lines 2-4, delete the words "AND METHODS OF PREPARATION AND USE THEREOF" from the title.

In Column 1, Line 31, after "etc" insert a period.

In Column 1, Line 51, the last word "areas" should be followed by a period rather than a comma.

In Column 9, Line 9, "e.g.," should read --,i.e.,--.

In Column 9, Lines 40-41, "adhesive" should be followed by a period.

In Column 12, Line 31, "0:2" should read --0.2--.

In Column 15, Line 25, "house" should read --hours--.

In Column 20, Line 35, after the word "major" insert --surface--.

Signed and Sealed this

Twelfth Day of November, 1991

*Attest:*

HARRY F. MANBECK, JR.

*Attesting Officer*

*Commissioner of Patents and Trademarks*